US005229057A

United States Patent [19]

Ohmory et al.

[11] Patent Number: 5,229,057

[45] Date of Patent: Jul. 20, 1993

[54] PROCESS OF MAKING HIGH-STRENGTH POLYVINYL ALCOHOL FIBER

[75] Inventors: Akio Ohmory; Hirofumi Sano; Hayami Yoshimochi; Tomoyuki Sano, all of Kurashiki; Syunpei Naramura, Thukubogun, Japan

[73] Assignee: Kuraray Co., Ltd., Kurashiki, Japan

[21] Appl. No.: 633,955

[22] Filed: Dec. 26, 1990

[30] Foreign Application Priority Data

Dec. 27, 1989 [JP] Japan ..... 1-343263
Apr. 11, 1990 [JP] Japan ..... 2-96793

[51] Int. Cl.[5] ..... D01F 6/14
[52] U.S. Cl. ..... 264/185; 264/210.7; 264/210.8
[58] Field of Search ..... 264/185, 210.7, 210.8

[56] References Cited

FOREIGN PATENT DOCUMENTS

| | | | |
|---|---|---|---|
| 630201 | 10/1961 | Canada | 264/185 |
| 0146084 | 6/1985 | European Pat. Off. . | |
| 0273755 | 7/1988 | European Pat. Off. . | |
| 0338534 | 10/1989 | European Pat. Off. . | |
| 1369805 | 7/1964 | France . | |
| 46-12097 | 3/1971 | Japan | 264/185 |
| 46-12098 | 3/1971 | Japan | 264/185 |

*Primary Examiner*—Leo B. Tentoni
*Attorney, Agent, or Firm*—Oblon, Spivak, McClelland, Maier & Neustadt

[57] ABSTRACT

High-strength polyvinyl alcohol fiber is provided by extruding a polyvinyl alcohol dope solution through a spinneret into a coagulating bath, the spinneret being located such that substantially only its dope-extruding surface contacts the coagulating bath. This process can produce stably and at a low cost polyvinyl alcohol fibers with excellent strength.

6 Claims, 2 Drawing Sheets x 10,000 x 10,000

PROCESS OF MAKING HIGH-STRENGTH POLYVINYL ALCOHOL FIBER

BACKGROUND OF THE INVENTION

1. Field of the Invention

The present invention relates to a process for producing at a low cost polyvinyl alcohol (PVA) fiber having high strength and to a novel fiber obtained by said process.

2. Description of the Background

PVA fibers have higher strength and higher elastic modulus than polyamide, polyester and polyacrylonitrile fibers and have been principally used in various industrial fields. In recent years PVA has also been used as a replacement for asbestos in reinforcing cement and for reinforcing rubber, plastics, and like materials.

Several processes are known for obtaining PVA fibers having still higher strength. For example U.S. Pat. No. 4,440,711 discloses a process which employs the concept of gel-spinning and super-drawing, which was first used with diluted solutions of high-molecular-weight polyethylene. U.S. Pat. No. 4,698,194 shows a process of using an organic solvent for a dope solution and conducting dry-jet-wet spinning of the dope.

The dry-jet-wet spinning employed in the above inventions comprises extruding PVA solution through a nozzle and, via an air layer, introducing the extruded solution into a coagulating bath. Although the process utilizes a diluted solution, the solution cannot be a very diluted one, since the extruded solution must pass through an air layer while maintaining the form of continuous streams.

With a very diluted PVA solution, the polymer solution tends to stick to the spinneret surfaces and stable spinning is difficult to achieve. Where a spinneret having holes with small pitch is used, the polymer streams, just after the extrusion, tend to contact each other and stick to each other in the air and stable spinning is not possible. If spinning is ever conducted, the solidified filaments obtained become what are called stuck filaments, which will undergo filament breakage upon heat drawing at high ratios, which makes it difficult to obtain high-strength fiber. To solve this problem, the spinneret used must have a hole allocation with a large pitch, which means the spinneret cannot have very many holes, thus creating another problem of high production costs in commercial production. A large-diameter spinneret may be employed in order to increase the number of holes per spinneret, but it presents disadvantages of difficult handling and, in particular, extrusion tends to be uneven. Accordingly, the dry-jet-wet spinning is associated with several problems from the viewpoint of commercial production.

Wet spinning of PVA fiber is also known. See, for example Japanese Patent Publication No. 16675/1968. In wet spinning, although it creates no such problems as associated with dry-jet-wet spinning, no fiber has yet been obtained which has high strength and high modulus. A study has now been conducted as to why conventional wet spinning cannot give a high-strength fiber. In wet spinning, the spinneret used and the dope piping connected thereto are immersed in a coagulating bath, and hence the coagulating bath temperature and the dope temperature influence each other. With a large difference between the two temperatures, an unevenness of temperature exists between the dope piping and the center and peripheral part of the spinneret used.

This temperature difference results in a viscosity unevenness in the dope, which makes regular and uniform extrusion impossible. This fact is one of the causes which obstructs the production of high-strength PVA fiber, and is very much so in particular with a low coagulating bath temperature of 20° C. or below. A need therefore continues to exist for an improved method of preparing PVA fibers.

SUMMARY OF THE INVENTION

Accordingly, one object of the present invention is to provide, while employing the wet spinning system which enables the use of a spinneret with very many holes, a process for producing high-strength PVA fiber stably and at low cost which assures regular and uniform extrusion.

Another object of the present invention is to provide a high-strength PVA fiber.

Thus, the present invention provides a process for producing high-strength PVA fiber which comprises dissolving a PVA having a viscosity average polymerization degree of at least 1,500 and extruding the obtained dope solution through a spinneret into a coagulating bath, the spinneret being located such that substantially only its dope-extruding surface contacts the coagulating bath.

The present invention also provides a high-strength PVA fiber made of a PVA having a polymerization degree of at least 1,500 and having a tensile strength of at least 15 f/denier (g/d) and having a primary roughened surface structure comprising a plurality of comparatively flat and longitudinally extending projections having a large width and a comparatively small height and a plurality of longitudinally extending recessions having a comparatively small depth, said projections and recessions being arranged alternately, and a secondary roughened surface structure comprising superfine longitudinally extending projections and recessions that are present on the primary roughened surface.

BRIEF DESCRIPTION OF THE DRAWINGS

A more complete appreciation of the invention and many of the attendant advantages thereof will be readily obtained as the same become better understood by reference to the following detailed description when considered in connection with the accompanying drawings, wherein.

In the FIGS. 1, 2, 3, 4 and 5 represent a spinneret, spinning dope, coagulating liquid, coagulating bath and heat-insulating or heating means, respectively. L is the immersion length as referred to in the present invention.

Figure 1:
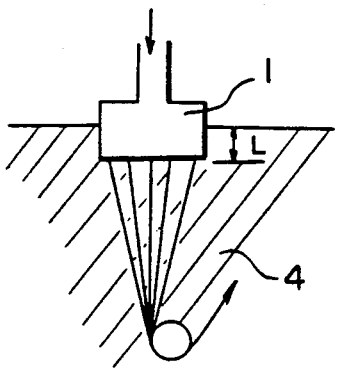
FIGS. 1 through 3 are schematic views illustrating the spinning process of the present invention.
Figure 2:
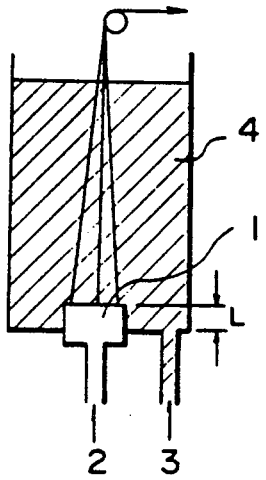
Figure 3:
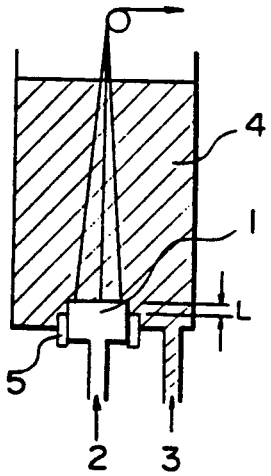
Figure 4:
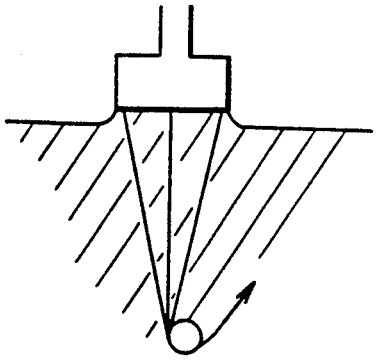
FIG. 4 is a schematic view illustrating a preferred embodiment of the spinning process of the present invention.

FIGS. 1 and 4 show flow-down wet spinning, the latter showing that the surface of the coagulating bath just touches the dope-extruding surface of a spinneret by action of surface tension, and FIGS. 2 and 3 show flow-up wet spinning.

DETAILED DESCRIPTION OF THE PREFERRED EMBODIMENTS

The PVA used in the present invention has an average polymerization degree obtained by viscosity measurement on its aqueous solution at 30° C. of at least 1,500. With polymerization degrees lower than 1,500, high-strength PVA fibers cannot be obtained. A viscosity average polymerization degree of at least 3,000, preferably at least 4,000 will more readily give a high-strength PVA fiber. A viscosity average polymerization degree of even at least 7,000 still more readily gives a high-strength PVA fiber, because of a smaller number of molecular ends which cause microstructural faults to generate. There is no particular limitation to the saponification degree of the PVA used, but it is preferably at least 98.5 mol %, and more preferably at least 99.9 mol %. Such PVA, in particular, possesses excellent hot water resistance. The PVA may be a copolymer PVA copolymerized with not more than 10 mol %, preferably not more than 2 mol % of another monomer having a vinyl group such as ethylene, itaconic acid or vinylpyrrolidone.

Any solvent that dissolves PVA can be used in the present invention and suitable examples include dimethyl sulfoxide (DMSO), dimethylformamide, dimethylimidazolidinone, water, glycerine, ethylene glycol, mixtures of 2 or more of the foregoing, such as DMSO/water, dimethylformamide/ethylene glycol, ethylene glycol or glycerine/water, n-propanol or isopropanol/water, and aqueous solutions of thiocyanates and the like. It is, however, preferred that from among the above solvents those giving a gelation temperature of the dope of not higher than 50° C. be selected, since in the present invention wet spinning into a coagulating bath having comparatively low temperature is effective in obtaining a fiber having high strength and a novel surface structure. In view of the above, glycerine alone or ethylene glycol alone is not preferred because they give comparatively higher gelation temperatures. DMSO dissolves PVA at 80° C. or below, which minimizes the decrease in the polymerization degree of PVA and is hence particularly preferred.

The PVA concentration in the spinning dope used is selected depending on the polymerization degree of the PVA and the type of solvent, but generally is 2 to 30% by weight, preferably 3 to 20% by weight. Since the objective of the present invention aims at a high-strength fiber, the PVA concentration preferably is as low as possible, which, with only a small entanglement of molecules, enables high-draft drawing, within a limit which does not create spinning problems such as frequent filament breakage, generation of uneven filaments and sticking between filaments.

The spinning dope may incorporate, depending on the intended use of the obtained fiber, various additives, e.g. a colorant such as a pigment, an antioxidant, an ultraviolet absorber, surfactant, pH adjusting agent such as an acid and a gelation accelerating agent such as boric acid, in required amounts. It is often preferred, for solvents having a comparatively high freezing point, such as DMSO, to be added with a substance having a coagulating function, such as methanol, in an amount which does not cause PVA to coagulate, since such addition protects the spinning dope from freezing even when the coagulating bath temperature is set below the freezing temperature of the solvent used.

The coagulating bath used in the invention comprises an organic solvent which is capable of coagulating PVA such as methanol, ethanol or acetone, as a principal component. These solvents may also be used in combination with each other or with the solvent for spinning dope. With conventional water-based coagulating baths employed in known wet spinning process, it is generally difficult to obtain a novel fiber having a special surface structure as described herein since they coagulate the extruded dope too rapidly.

The coagulating bath temperature employed is 20° C. or below. If the temperature exceeds 20° C., the coagulated fiber will have many voids, become opaque and nonuniform and will not be of high strength. The coagulating bath temperature is more preferably 15° C. or below, and most preferably 10° C. or below. Too low a coagulating bath temperature, however, cause the spinning dope which is extruded through the spinneret to freeze, thereby making extrusion impossible.

In the process of the present invention the spinneret used is, instead of being completely immersed in the coagulating bath as is normally done in the usual wet spinning process (cf. FIG. 6), located such that substantially only its dope-extruding surface contacts the coagulating bath having a bath temperature of 20° C. or below. (The term "spinneret" herein means an integral spinneret including the spinneret case to fix the spinneret, the filter, the flow straightening plate and the like.) The term "substantially only its dope-extruding surface contacts the coagulating bath" herein means that, with reference to FIGS. 1 and 2, the length, L, of the spinneret part, with its end surface extruding the dope, being immersed in and directly touching the coagulating bath and directly being subjected to the coagulating bath temperature, is not more than 30 mm, preferably not more than 20 mm, most preferably not more than 10 mm. Further, with reference to FIG. 3, where the side of a spinneret is partly or even fully covered with a heat-insulating or heating means, the immersion length, L, means the length of the part of the spinneret immersed in and directly touching the coagulating bath, i.e. the length between the dope-extruding surface and the end of such heat-insulating or heating medium covering the spinneret side. It is most preferred that, as shown in FIG. 4, only the dope-extruding surface of the spinneret touch the coagulating bath by action of surface tension, i.e. $L=0$. It is also very much preferred that, in the flow-up wet spinning process as shown in FIG. 3, the side of the spinneret be fully covered with a heat-insulating or heating medium, so that only its dope-extruding surface directly touches the coagulating bath, i.e. $L=0$.

The dry-jet-wet spinning process has been used for producing high-strength PVA, its principal advantage being considered to be that spinning dope and coagulating bath do not contact each other and are independent with respect to thermal conductivity so that their temperatures can be set largely apart from each other. On the other hand, the conventional wet spinning process for obtaining high-strength PVA enables the spinning dope to be of lower PVA concentration than dry-jet-wet spinning and thus can use a spinning dope with smaller molecular-chain entanglement, with the result that the process has the possibility of yielding fiber having higher strength. Nevertheless, the wet spinning process has not been capable of providing high-strength PVA fiber; because, as described hereinbefore, when in this process a large temperature difference between spinning dope and coagulating bath is employed, extrusion through spinneret holes becomes nonuniform, which creates uneven coagulation and large variation in the finenesses of the filaments prepared. This tendency is even more noticeable when an organic solvent is used.

The present invention is based on the finding that if wet spinning is conducted through a spinneret located such that substantially only its dope-extruding surface contacts the coagulating bath used, the degree of the above unevenness of coagulation and the fineness variation described above are, unexpectedly, much smaller even under the conditions of a large temperature difference between the spinning dope and the coagulating bath than those of the conventional wet spinning process. With the immersion length exceeding 30 mm, the amount of heat exchange between the coagulating bath and the spinning dope inside the spinneret will become large which increases local temperature nonuniformities in the dope or coagulating bath, thereby increasing coagulation unevenness and fineness variation. The immersion length is preferably not more than 20 mm and more preferably not more than 10 mm. In the most preferred embodiment of the present invention, only the dope-extruding surface of the spinneret used contacts the coagulating bath. This state can readily be realized in a flow-down system as shown in FIG. 4 by action of surface tension between the spinneret surface and the coagulating bath. In the case of FIG. 4, where only the dope-extruding surface contacts the coagulating bath, a slight rippling on the coagulating bath surface might cause the surface to detach from the dope-extruding surface of the spinneret. In practice, unexpectedly, it has been confirmed experimentally that the coagulating bath cannot be separated from the dope-extruding surface by a slight or even relatively large ripples and that this state is maintained for a long period of time. This surface tension is believed to be a factor which contributes to this condition.

The present invention not only is applicable to the flow-down system, as shown in FIGS. 1 and 4, but produces the same effect with the flow-up system shown in FIG. 2, as long as substantially only the dope-extruding surface of the spinneret contacts the coagulating bath, that is, the immersion length is within the above-described range.

It may often work, as stated before, to mount a cover made of a plastic or, preferably, plastic foam having good heat-insulating properties around the spinneret in order to suppress the temperature decrease at its dope-extruding surface and to prevent the coagulating bath temperature from being influenced by the dope temperature. It is further preferred to mount a heating means to heat the dope-extruding part of the spinneret, either singly or in combination with a heat-insulating means, around the spinneret, thereby preventing the flow of heat between the dope-extruding part and the coagulating bath.

The extruded dope is taken up, while being coagulated, on a first roller located in or above the coagulating bath at a bath draft, which is defined as the ratio of the linear speed of the dope passing the spinneret holes to the circumferential speed of the first roller, of preferably 0.1 to 0.5. The coagulated gel is formed into fiber in the following manner. The solvent and other extractables in the gel are washed and extracted with an extracting liquid such as methanol or water, and the residual fiber-shaped gel is dried. Before drying, it is preferred that the fiber be wet drawn in a ratio of at least 2 by 1-stage or, preferably, a multi-stage drawing, which prevents sticking during drying. The wet drawing ratio is more preferably 2.5 to 5.5. A wet drawing ratio of 6 or more should be avoided, because it causes filament breakage to occur frequently or the fiber cross-section to deform. The drying temperature is preferably 30° to 150° C. from the viewpoint of drying efficiency and the properties of the finished fiber. The thus dried fiber is then heat drawn at high temperature and in a high ratio to orient and crystallize its molecules, thereby becoming a high-strength fiber. The heat drawing is conducted at a temperature of preferably at least 210° C., more preferably 220° to 250° C. to a total drawing ratio of preferably at least 16, more preferably at least 18, most preferably at least 20. The process of the present invention provides a uniform as-spun fiber with little uneven coagulation and only a small fineness variation, thereby enabling high-draft drawing to form high-strength fibers. The heat drawing can be conducted by dry heating, in a heating medium such as silicone or by wet heating such as in high-temperature steam, and by one-stage or 2- or more stage drawing. The thus heat drawn fiber may then be, as required, heat treated or heat shrunk.

As stated heretofore, the gist of the present invention resides in shortening of the immersion length of the spinneret and lowering of the coagulation bath temperature down below 20° C. to increase the gelation or solidification speed and slowly extract the solvent used. This process gives as-spun fiber of little uneven coagulation and fineness variation. Heat drawing the thus obtained uniform as-spun fiber in a high drawing ratio of at least 16 can give, stably and at a low cost, high-strength and high-modulus PVA fiber.

It has been found that the fiber obtained by the above-described process of the present invention has not only high strength and modulus, but high resistance to transverse abrasion, as well as higher reinforcement function for matrices such as cement than that of known high-strength PVA fiber. The mechanism of this high reinforcement function is attributable to a special surface structure of the fiber.

Thus, the fiber of the present invention has a high tensile strength of at least 15 g/d and, at the same time, carries on its surface a plurality of longitudinally extending and comparatively flat projections with small height and comparatively large width, and recessions, the projections and recessions being arranged parallel and alternately. In other words, the fiber of the present invention has, on its surface, stripes of low, wide "ridges" continuously and longitudinally extending parallel along the fiber axis.

This surface structure is not like the known structure of medium-strength PVA fiber shown for example in Japanese Patent Publication No. 32144/1987, that comprises large and rough "pleats" having a sharp-angled top, or like one of the high-strength PVA fibers obtained by dry-jet-wet spinning shown for example in U.S. Pat. No. 4,698,711, that is comparatively small and principally comprises superfinely roughened surface, but is characterized by a so to speak arithmetic mean of these two.

Figure 7:
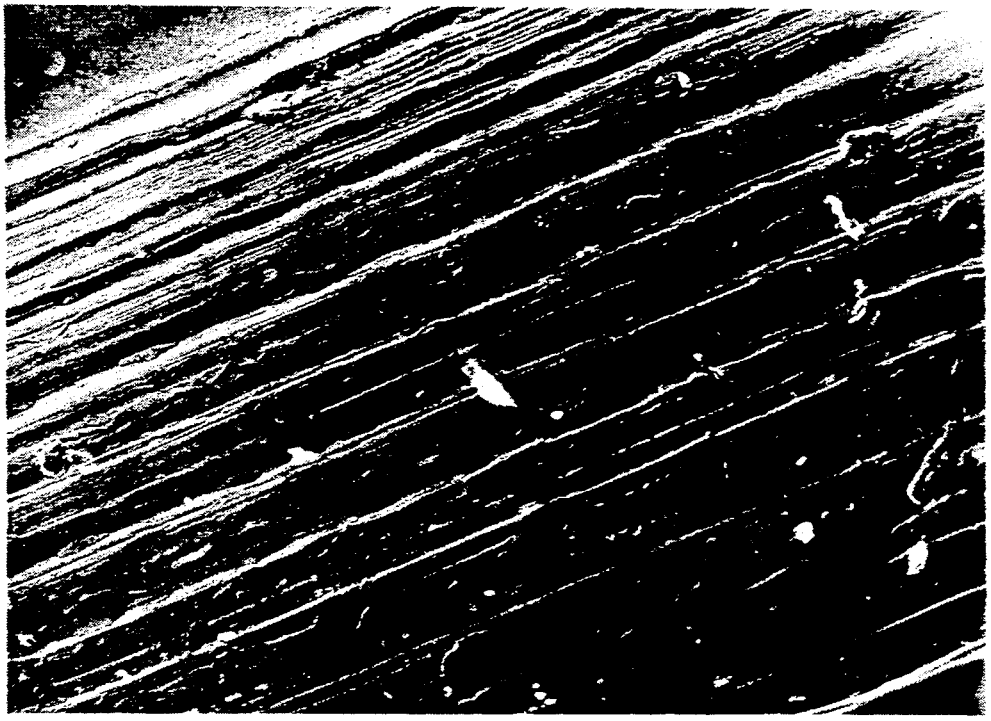
FIG. 7 is an electron photomicrograph with a magnification of 10,000 of an example of the surface structure of the fiber obtained by the process of the present invention.
Figure 8:
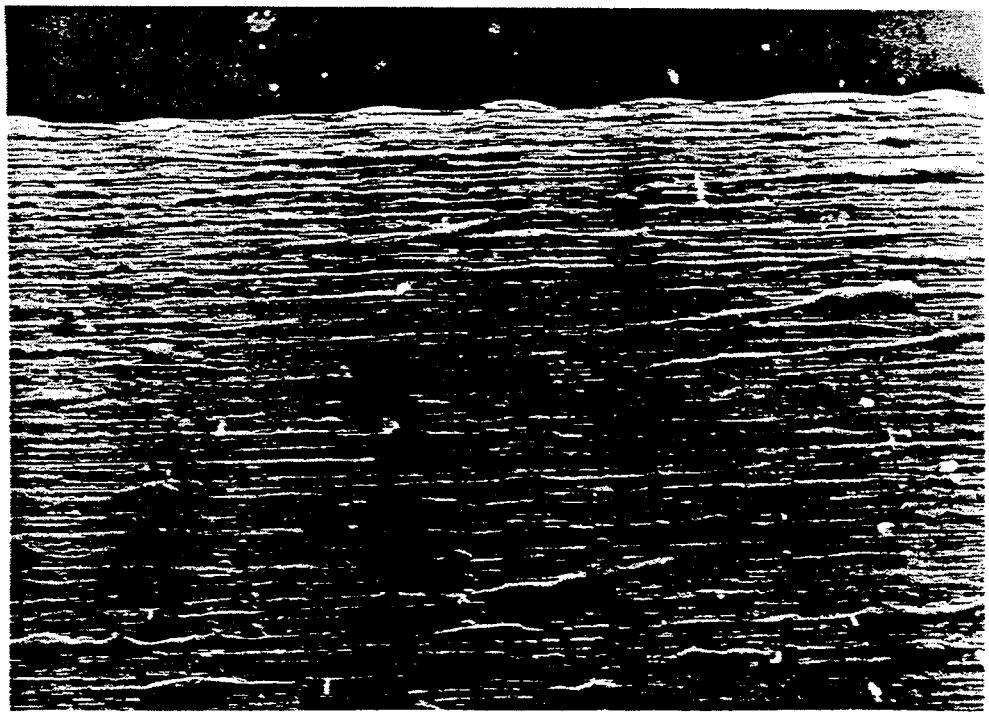
Figure 8 PRIOR ART
FIG. 8 shows an electron photomicrograph with a magnification of 10,000 of an example of the surface structure of the fiber obtained by known dry-jet-wet spinning process.

For the purpose of defining the fiber of the present invention, it is necessary to precisely describe the fine surface structure by an accurate observation method. The usual scanning electronmicroscopy requires metal-coating the surface of the specimen to be observed to a thickness of at least 0.01 μm, which then renders it impossible to accurately reproduce the finely roughened surface structure characteristic of this fiber. In the present invention, a replica method described hereinafter was therefore employed and surface observation was conducted by electron microscopy. FIG. 7 is a photograph obtained by reverse-printing to a total magnification of 10,000 an electron photomicrographic negative at a magnification of 5,000 of a replica of the surface of the fiber of the present invention. FIG. 8 is a reverse-printed photograph at a total magnification of 10,000 of a surface replica of the fiber obtained in Comparative Example 1.

The surface of the fiber of the present invention is characterized by a "two-fold" roughened surface structure comprising a plurality of comparatively large primary projections and recessions arranged alternately and extending continuously along the fiber axis and a plurality of secondary fine projections and recessions that are present on and definitely finer than the former. The primary roughened surface has a plurality of longitudinally extending projections and recessions having a width of 0.1 to 2μ, preferably 0.2 to 1 μm, and a height, or depth, of 0.05 to 0.4 μm, more preferably 0.07 to 0.2 μm. If the height of the projections exceeds 0.4 μm, the fiber will tend to be of low strength or low resistance to abrasion in a direction perpendicular to the fiber axis.

Another feature of the fiber of the present invention is that its primary projections and recessions have, while their width is as fine as not more than 2 μm, as large a length as at least 10 μm. With a length of primary projections or recessions of less than 10 μm, the fiber will not, like that with too narrow projections, produce a satisfactory reinforcement effect. It is more preferred that the primary projections and recessions have a length of at least 10 mm. Then, when this fiber is cut to lengths of 10 mm and is used for reinforcing purposes, the primary projections and recessions continuously extend all through the lengths, which is believed to enhance the reinforcement effect.

The secondary projections and recessions are superfine and have a width and a height each of 0.01 to 0.05 μm.

To summarize, the high-strength PVA fiber of the present invention has a tensile strength of at least 15 g/d and has the following surface structure as observed on the reverse print of a transmission-type electron photomicrograph of a replica film of the surface:

(1) Width of the primary projections or recessions: 0.1 to 2 μm (2) Depth of the primary projections or recessions: 0.05 to 0.4 μm (3) Length of the primary projections or recessions: at least 10μ

(4) Width and height of the secondary projections or recessions: 0.01 to 0.05 μm.

It is more preferred that the above primary roughened structure of the PVA fiber of the present invention comprise a plurality of flat and wider projections and narrower recessions; more concretely, the fiber surface comprises a plurality of longitudinally extending comparatively flat and wider primary projections and a plurality of comparatively low and narrower primary recessions each of which lies between two neighboring ones of the primary projections, the ratios of the width of the primary projections $W_1$ to the width $W_2$ and depth d of the primary recessions, $W_1W_2$ and $W_1/d$ being both at least 1.

It is not clear why the above-described process of the present invention provides a fiber having high strength and the two-fold finely roughened surface structure. The formation of the primary roughened structure is believed to be deeply related to wet spinning of the extrudate into a low-temperature coagulating bath comprising principally an organic solvent. Where wet spinning is conducted with a water-based coagulating bath, as shown in the aforementioned Japanese Patent Publication No. 32144/1987, the obtained fiber has a more coarsely roughened and more readily crushable surface structure with projections and recessions having a width of 0.5 to 2 μm and a depth of 0.5 to 1 μm than that of the fiber of the present invention. Solidification in an organic solvent coagulating bath involves a different mechanism from that in a water-based coagulating bath, the former leading to more uniform solidification, which provides, estimatedly, a more finely roughened surface structure. However, even where an organic solvent coagulating bath is used, in dry-jet-wet spinning by which extruded polymer streams first contact an inert gas, the rougher primary projections and recessions do not form, while finer projections and recessions corresponding to the secondary roughened surface of the fiber of the present invention do form, as shown in FIG. 8. This is believed to be due to the following.

In the wet spinning process, coagulation of extruded dope starts just after the extrusion, particularly on its surface. Then the extruded dope coagulates while the tension on the coagulated fiber directly applies to the spinneret hole, whereby the viscoelastic state of the dope just before extrusion is memorized on the surface of the coagulated fiber and then subjected to relaxation. On the other hand, in dry-jet-wet spinning, dope is extruded into an atmosphere of an inert gas and hence solidifies slowly, whereby the original viscoelastic state undergoes relaxation before the solidification and the surface of the dope stream also solidifies after the relaxation.

Thus, the large difference in surface structure of fibers obtained by wet spinning and dry-jet-wet spinning is that the solidification speed of the surface of the extruded polymer stream just after extrusion is much larger with wet spinning, where relaxation occurs after surface coagulation, than with dry-jet-wet spinning, where solidification occurs after relaxation. From the fact that the secondary roughened surface structure with wet spinning has about the same fineness as that with dry-jet-wet spinning, this micro-finely roughened secondary structure is believed to have developed during the period of removal of solvent from solidified fiber and actualized through processes of wet drawing and dry heat drawing.

The methods for determining the polymerization degree of PVA and the tensile strength of fiber are herewith described. Measurements of the width, depth and length of the primary projections and recessions and the width and depth of the secondary projections and recessions of fiber by electron photomicroscopy are also described.

(i) Polymerization Degree of PVA

The method of JIS K6726 is employed to determine the intrinsic viscosity [η] of an aqueous solution at 30° C. and the polymerization degree $P_A$ is calculated by:

$$\log \overline{P}_A = 1.63 \log ([\eta] \times 10^4/8.29)$$

(ii) Fiber Strength

The tensile strength of a previously conditioned fiber specimen is determined in accordance with the method of JIS L1013 under the conditions of a gauge length of 4 cm, rate of extension of 100%/min and an initial load of 0.25 g/d. An average of n=10 is reported. The fineness in deniers is determined by weight measurement.

(iii) The width, depth and length of the primary roughened surface structure and the size of the secondary roughened surface structure, of fiber:

A first-stage molding replica of a specimen fiber is prepared by pressing the specimen onto a polyethyl methacrylate film at 120° C./0.8 kg. The replica is shadowed by vacuum depositing a platinum/palladium alloy in a direction perpendicular to the fiber axis at an angle of θ against the film surface, where tan θ=0.7. The shadowed replica is reinforced by vacuum depositing carbon thereon in the direction perpendicular to the fiber axis and the film surface and then the polyethyl methacrylate film is dissolved off. The 2-stage replica thus prepared is held on a sheet mesh and photographed with a transmission-type electron photomicrographer at a magnification of 5,000.

The widths and lengths of the fine projections and recessions are measured on a reverse-printed photograph enlarged to a magnification of 30,000 and the depth is calculated from the above shadowing angle.

The photograph used in this measurement is taken on a specimen replica obtained by shadowing a first-stage replica with an alloy by vacuum deposition at a specified angle. The photograph should therefore be observed while the angle at which the shadowing was done is taken into consideration.

The projections and recessions in the present specification appear on the above photograph by bright parts and dark parts respectively. Thus, the continuous projections appear as bright stripes and the continuous recessions as dark stripes. The width of a projection and a recession therefore is determined from the photograph as the width of the bright stripe and dark stripe, respectively, along a straight line drawn in a direction perpendicular to the fiber axis. The width is measured on a multiplicity of bright stripes and dark stripes on the photograph of a specimen filament, and this measurement is conducted on at least 5 specimens to determine the maximum and minimum values.

The depth, or height, of a projection or a recession is, strictly speaking, to be measured on a number of photographs of cross-sections of a specimen fiber. It has been found, however, that the depth thus determined is nearly equal to that calculated from the width obtained from the above-mentioned electron photomicrograph and shadowing angle. In the present specification, the calculated value is therefore employed for convenience sake instead of time-consuming measurements on cross-sectional photographs.

In the above measurements on photomicrographs, the stereo-graphical view of a specimen fiber is projected on a plane. To minimize errors occurring at the edge parts, only the central part within about 60% of fiber diameter is observed, while 20% each corresponding to edge parts is excluded.

Other features of the invention will become apparent in the course of the following descriptions of exemplary embodiments which are given for illustration of the invention and are not intended to be limiting thereof.

EXAMPLE 1

A PVA solution was prepared by dissolving a PVA having a polymerization degree of 3,900 and a saponification degree of 99.9 mol % in dimethyl sulfoxide at 80° C. under an atmosphere of nitrogen to a concentration of 9% by weight. The spinning dope thus obtained was, at 60° C., extruded through a spinneret with 300 holes with a pitch of 2.1 mm and having a hole diameter of 0.16 mm down into a coagulating bath comprising methanol/dimethyl sulfoxide =65/35 at 2° C., to effect wet spinning. At this time the spinneret was located such that only its dope-extruding surface contacted the coagulating bath by action of surface tension, as shown in FIG. 4. The bath draft was 0. 21. The solidified fiber obtained was passed through a methanol bath to extract dimethyl sulfoxide and was drawn in 2 stages to a total wet drawing ratio of 4.2 and then dried by hot air flow at 70° C. The as-spun fiber thus obtained was heat drawn through a heating oven having a temperature gradient of 175°-195°-233° C. to a total drawing ratio of 20.5. The fiber thus obtained showed a tensile strength of 20.1 g/d. The replica of the surface of the fiber was prepared in the above-described manner and photographed with an electron microscope at a magnification of 5,000. The negative was enlarged to a magnification of 10,000 and printed. FIG. 7 shows the photograph.

The primary and secondary projections and recessions were measured for their sizes on a 30,000-enlarged reverse-printed photograph. The widths of the primary projections and recessions ranged from 0.2 to 1.0 μm and 0.1 to 0.8 μm, respectively, and the depths ranged from 0.1 to 0.2 μm. The lengths of the projections and recessions were confirmed to be at least 50 μm, from the fact that the same roughened pattern was observed on a spot shifted 50 μm longitudinally. The sizes of the secondary projections and recessions ranged from 0.02 to 0.03 μm. Accordingly, the strength and all the sizes of the primary and secondary roughened surface structures were within the scope defined by the present invention.

The fiber was dispersed in a matrix of Portland cement and the mixture was wet-formed and cured. The thus obtained cement board had excellent flexural strength, thereby proving a good reinforcement effect on the part of the fiber. The fiber also gave an excellent result in a test for resistance to abrasion in a direction perpendicular to the fiber axis.

COMPARATIVE EXAMPLE 1

Figure 5:
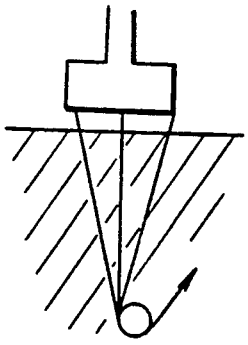
Figure 5 PRIOR ART
FIGS. 5 and 6 are schematic views illustrating a conventional dry-jet-wet spinning process and wet spinning process, respectively.

An attempt was made to conduct dry-jet-wet spinning of the same spinning dope as used in Example 1, by providing, as shown in FIG. 5, an air layer of about 5 mm thick between the spinneret surface and the coagulating bath. It was found impossible to continue spinning because of too low a dope viscosity. Then, the PVA concentration was increased to 12% by weight and the 5 mm thick air layer provided as above, another dry-jet-wet spinning was attempted under the same conditions of coagulating bath composition, wet drawing, extraction and drying as those in Example 1. The dried fiber however could not but be drawn only to a total drawing ratio of 17. The obtained fiber showed a tensile strength of 17.1 g/d, lower than that of Example 1, but higher than conventional PVA fibers. FIG. 8 shows a 10,000-enlarged electron photomicrograph of the fiber surface. Observation of a further 60,000-enlarged photomicrograph revealed that the surface structure had projections and recessions having a size of 0.01 to 0.02 μm corresponding to the secondary projections and recessions of the fiber of the present invention, but that the structure had no larger ones corresponding to primary projections and recessions, thus being definitely different from that of Example 1.

The obtained fiber was formed into a cement board in the same manner as described in Example 1. The cement board obtained showed a lower flexural strength than that of Example 1.

EXAMPLE 2

A PVA solution was prepared by dissolving a PVA having a polymerization degree of 7,600 and a saponification degree of 99.9 mol % in dimethyl sulfoxide to a concentration of 6% by weight. The spinning dope thus obtained was, at 55° C., extruded through a spinneret with 300 holes with a pitch of 2.1 mm and having a hole diameter of 0.16 mm down into a coagulating bath comprising methanol/dimethyl sulfoxide=65/35 at 5° C., to effect wet spinning in the same manner as described in Example 1 and as shown in FIG. 4. The fiber was heat drawn at 243° and up to a total draft of 19.2 was possible. The fiber thus obtained showed a high tensile strength of 21 .8 g/d. Observations by the method of the present invention on the surface of the fiber revealed that the widths of the primary projections and recessions were 0.3 to 0.8 μm and 0.1 to 0.5 μm, respectively, and the depths were 0.1 to 0.2 μm. The lengths of the projections and recessions were 120 μm. The sizes of the secondary projections and recessions were 0.02 to 0.03 μm.

EXAMPLE 3

A PVA solution was prepared by dissolving, under an atmosphere of nitrogen, a PVA having a viscosity average polymerization degree of 4,100 and a saponification degree of 99.8 mol % in dimethyl sulfoxide at 80° C. to a concentration of 9% by weight. The spinning dope thus obtained was, at 65° C., extruded through a spinneret with 40 holes with a pitch of 2 mm and having a hole diameter of 0.12 mm down into a coagulating bath comprising methanol/dimethyl sulfoxide=7/3 at 0° C., to effect wet spinning, while the spinneret was so located as to touch the coagulating bath only with its dope-extruding surface by action of the surface tension of the coagulating bath as shown in FIG. 4. The solidified fiber was passed through a methanol bath where dimethyl sulfoxide was extracted and the fiber was wet drawn in 2 stages to a wet drawing ratio of 4, and then dried by hot air flow at 90° C. The fiber was then heat drawn through a hot air oven having a temperature gradient of 170°-190°-235° C. to a total drawing ratio of 22. Operation all through these processes was stable without any trouble such as wrapping around a roll, and the obtained fiber had a round cross-section. The fiber showed a tensile strength of 20.8 g/d, an elastic modulus of 475 g/d and a variation of single filament fineness of 8%.

COMPARATIVE EXAMPLE 2

An attempt was made to conduct dry-jet-wet spinning as shown in FIG. 5 using the same spinning dope and spinneret as used in Example 3. With the hole pitch of 2 mm, the extruded dope streams stuck to each other and stable spinning was impossible. The spinneret was changed to one with 40 holes with a pitch of 5 mm and having a hole diameter of 0.12 mm, and dry-jet-wet spinning was conducted through an air layer 5 mm thick and into the coagulating bath. The PVA dope, the same as that used in Example 3, here was of too low a viscosity due to low concentration, and hence filament breakages occurred partly to cause roller wrapping, whereby stable operation could not be continued.

COMPARATIVE EXAMPLE 3

Example 3 was repeated except for immersing the spinneret as shown in FIG. 1 in the coagulating bath, by a length of 35 mm, to effect wet spinning. No stable extrusion through the spinneret was possible, with the extruded dope streams showing a large size variation. The variation of fineness of the as-spun filaments was as large as 19%. The as-spun fiber was drawn in the same manner as described in Example 3, where frequent filament breakages occurred and the total drawing ratio had to be decreased to 17. The fiber thus obtained showed a low yarn strength of 16.5 g/d.

COMPARATIVE EXAMPLE 4

Figure 6:
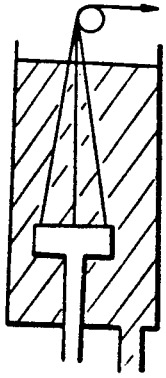
Figure 6 PRIOR ART

The same spinning dope as used in Example 3 was extruded through a spinneret with 300 holes with a pitch of 0.8 mm and having a hole diameter of 0.11 mm up into a coagulating bath comprising methanol/dimethyl sulfoxide=85/15 at 5° C., while the spinneret was immersed in the bath by an immersion length of 80 mm, as shown in FIG. 6, to effect flow-up wet spinning. Microscopy on the cross-section of the obtained fiber revealed a large unevenness and the fineness variation of single filaments was found to be as large as 34%.

EXAMPLE 4

A PVA solution was prepared by dissolving a PVA having a viscosity average polymerization degree of 4,100 and a saponification degree of 99.8 mol % in dimethyl sulfoxide at 80° C. under an atmosphere of nitrogen to a concentration of 8% by weight. The spinning dope thus obtained was, at 60° C., extruded through a spinneret with 300 holes with a pitch of 1.8 mm and having a hole diameter of 0.11 mm down into a coagulating bath comprising methanol/dimethyl sulfoxide=6/4 at 2° C., to effect flow-down type wet spinning as shown in FIG. 1, while the immersion length of the spinneret was set to 4 mm. The solidified fiber was passed through a methanol bath where dimethyl sulfoxide was extracted and the fiber was wet drawn in 3 stages to a total wet drawing ratio of 3.5, and then dried by hot air flow at 90° C. The as-spun fiber thus obtained was then heat drawn through a hot air oven having a temperature gradient of 180°-200°-240° C. to a total drawing ratio of 21. Operation all through these processes was stable without any trouble such as wrapping, and the obtained fiber had a small variation of single filament fineness of 5% and an excellent tensile strength of 21.5 g/d.

COMPARATIVE EXAMPLE 5

Example 4 was repeated except that the coagulation bath temperature was set to 25° C. The solidified fiber was whitened, and the heat drawn fiber showed a yarn strength of only 18.7 g/d perhaps because of the presence of many voids.

EXAMPLE 5

A PVA solution was prepared by dissolving a PVA having a viscosity average polymerization degree of 8,000 and a saponification degree of 99.5 mol % in a mixed solvent of dimethyl sulfoxide/water=8/2 to a concentration of 6% by weight. The spinning dope thus obtained was, at 90° C., extruded through a spinneret with 1,000 holes with a pitch of 1.8 mm and having a hole diameter of 0.18 mm down into a coagulating bath, with the spinneret touching the coagulating bath only with its dope-extruding surface as shown in FIG. 4, to effect flow-down type wet spinning. The coagulating bath comprised ethanol/water=95/5 and was at a temperature of −2° C. The solidified fiber was drawn through an ethanol bath in 2 stages to a total wet drawing ratio of 3, and then dried by hot air flow at 100° C. to be an as-spun fiber with almost no water or ethanol. The as-spun fiber was then heat drawn through a radiation type hollow tube heater having a temperature gradient of 170°-250° C. to a total drawing ratio of 20.4. The obtained fiber had a high yarn strength of 21.8 g/d.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by letters patent of the United States is:

1. A process for producing high-strength polyvinyl alcohol fiber comprising:

dissolving a polyvinyl alcohol having a viscosity average polymerization degree of at least 3,000 in a solvent; and extruding the obtained doped solution through a spinneret into a coagulating bath so as to conduct flow-up wet spinning, said spinneret being immersed in said coagulating bath to a length of not more than 20 mm and being covered, on all of its sides that are immersed in the coagulating bath, with a heat-insulating means or heating means so that only the dope-extruding surface of said spinneret touches the coagulating bath, said coagulating bath comprising an organic solvent and having a bath temperature of 15° C. or below.

2. The process for producing high-strength polyvinyl alcohol fiber according to claim 1, wherein the extruded fiber before drying is wet drawn in one or more stages to a total wet drawing ratio of 2 to 6.

3. The process for producing high-strength polyvinyl alcohol fiber according to claim 1, wherein the fiber after drying is dry heat drawn at not lower than 210° C. in one or more stages to a total drawing ratio including wet drawing ratio of at least 16.

4. A process for producing high-strength polyvinyl alcohol fiber comprising:

dissolving a polyvinyl alcohol having a viscosity average polymerization degree of at least 1,500 in a solvent; and extruding the obtained doped solution through a spinneret into a coagulating bath so as to conduct flow-up wet spinning, said spinneret being immersed in said coagulating bath to a length of not more than 20 mm and being covered, on all of its sides that are immersed in the coagulating bath, with a heat-insulating means or heating means so that only the dope-extruding surface of said spinneret touches the coagulating bath, said coagulating bath comprising an organic solvent and having a bath temperature of 15° C. or below.

5. The process for producing high-strength polyvinyl alcohol fiber according to claim 4 wherein the extruded fiber before drying is wet drawn in one or more stages to a total wet drawing ratio of 2 to 6.

6. The process for producing high-strength polyvinyl alcohol fiber according to claim 4 wherein the fiber after drying is dry heat drawn at not lower than 210° in one or more stages to a total drawing ratio including wet drawing ratio of at least 16.

* * * * *